US005088540A

United States Patent [19]

Harris

[11] Patent Number: 5,088,540

[45] Date of Patent: Feb. 18, 1992

[54] WINDOW RAINSHIELD APPARATUS

[76] Inventor: Shirley J. Harris, 1908 Wellington Way, Fort Smith, Ark. 72903

[21] Appl. No.: 622,546

[22] Filed: Dec. 5, 1990

[51] Int. Cl.[5] ..... E06B 7/03

[52] U.S. Cl. ..... 454/220; 454/214; 160/90

[58] Field of Search ..... 160/90, 222, 19, 352, 160/88, 89; 98/44, 99.01, 99.3, 995; 55/279

[56] References Cited

U.S. PATENT DOCUMENTS

| | | | |
|---|---|---|---|
| 978,417 | 2/1910 | Dunlap | 98/99.5 |
| 1,465,722 | 8/1912 | Thomas | 98/99.5 |
| 1,660,793 | 2/1928 | Hodge | 98/99.5 |
| 1,719,980 | 7/1929 | Imbruglia | 98/99.5 |
| 2,240,406 | 4/1941 | Kurtz | 98/99.01 X |
| 4,252,547 | 2/1981 | Johnson | 55/279 X |
| 4,367,203 | 1/1983 | Landsberger | 55/279 X |

FOREIGN PATENT DOCUMENTS

| | | | |
|---|---|---|---|
| 0087486 | 7/1983 | European Pat. Off. | 98/44 |

*Primary Examiner*—Carl D. Friedman
*Assistant Examiner*—Derek J. Berger
*Attorney, Agent, or Firm*—Leon Gilden

[57] ABSTRACT

An apparatus arranged for mounting interiorly of a window between a lowermost window sash and a window sill provided with spaced triangular side walls an a telescoping forward housing receiving a shield plate therewithin. Both the shield plate and housing include a ceiling flange arranged at an obtuse included angle relative to the plate and housing surface respectively. Further, a filtration screen and a motorized fan assembly is positionable overlying an upper peripheral edge of the organization to enhance ventilation into an associated interior room.

1 Claim, 4 Drawing Sheets

Fig 3
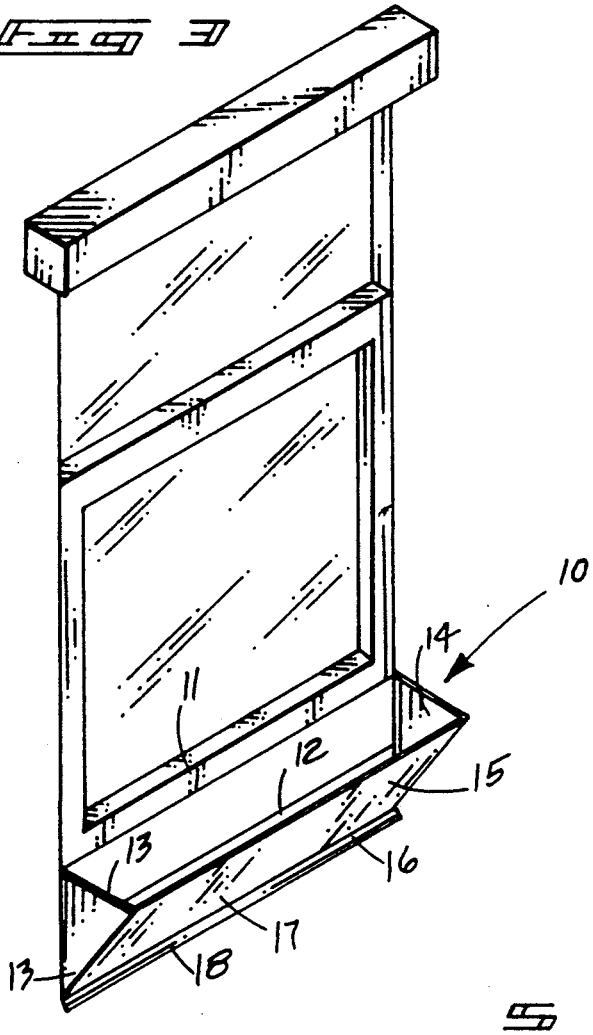
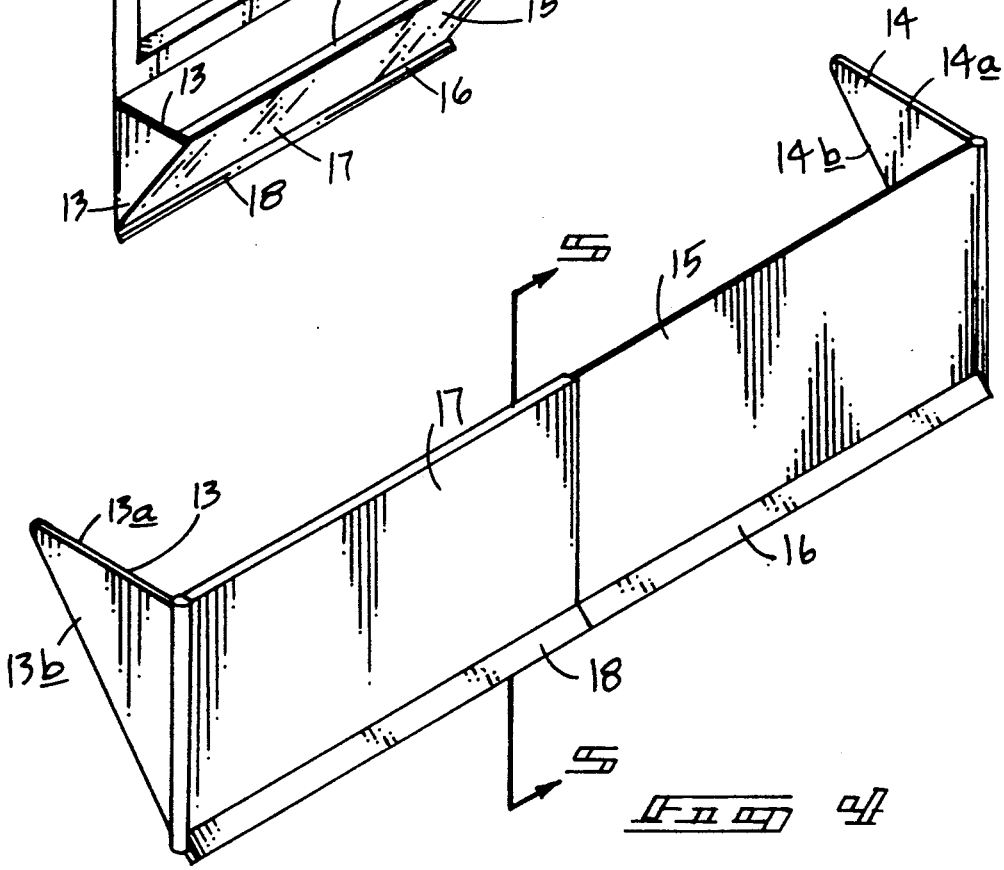
Fig 4

WINDOW RAINSHIELD APPARATUS

BACKGROUND OF THE INVENTION

1. Field of the Invention

The field of invention relates to window shield arrangements, and more particularly pertains to a new and improved window rainshield apparatus wherein the same is positioned interiorly of a window within a housing structure to prevent intrusion of water due to rain minimizing dust directed into the house while permitting the free-flow of air therewithin.

2. Description of the Prior Art

Various shielding arrangements have been mounted relative to window surfaces to deflect wind, rain, and the like from entering an interior dwelling. The instant invention attempts to overcome deficiencies of the prior art by permitting mounting of an organization to an interior surface of a window between the lowermost window sash and a window sill. Examples of prior art include U.S. Pat. No. 2,663,245 to Fairbairn wherein a window ventilation member is mounted adjacent and forwardly of a window mounted to the forward faces of the framework, with the organization open at the bottom and top thereof to permit ventilation therethrough.

U.S. Pat. No. 3,116,519 to Keith sets forth a window guard of a generally "U" shaped configuration to a rod-lkie framework forwardly of a window.

U.S. Pat. No. 1,475,103 to Wood sets forth a window ventilation member that is pivotally mounted to a window at a lowermost end thereof and permits pivotment in a plurality of angulations to permit airflow underlying or overlying the shield.

U.S. Pat. No. 1,406,089 to Schaffer sets forth a shield organization that may be relatively folded to permit shifting of winds into a room, and wherein the organization is mounted to a forward surface of the window framework.

U.S. Pat. No. 4,545,148 to Shaw sets forth a shield-like member to mount relative to sliding windows and domestic windows providing weather protection, as well as noise reduction thereto.

As such, it may be appreciated that there continues to be a need for a new and improved window rainshield organization as set forth by the instant invention which addresses both the problems of ease of use as well as effectiveness is construction and in this respect, the present invention substantially fulfills this need.

SUMMARY OF THE INVENTION

In view of the foregoing disadvantages inherent in the known types of window shield arrangements now present in the prior art, the present invention provides a window rain shield apparatus wherein the same is arranged for mounting between a lower window sash and window sill to effect blockage of debris and rain from entering an interior portion of a dwelling. As such, the general purpose of the present invention, which will be described subsequently in greater detail, is to provide a new and improved window rain shield apparatus which has all the advantages of the prior art window shield apparatus and none of the disadvantages.

To attain this, the present invention provides an apparatus arranged for mounting interiorly of a window between a lowermost window sash and a window sill provided with spaced triangular side walls and a telescoping forward housing receiving a shield plate therewithin. Both the shield plate and housing include a ceiling flange arranged at an obtuse included angle relative to the plate and housing surface respectively. Further, a filtration screen and a motorized fan assembly is positionable overlying an upper peripheral edge of the organization to enhance ventilation into an associated interior room.

My invention resides not in any one of these features per se, but rather in the particular combination of all of them herein disclosed and claimed and it is distinguished from the prior art in this particular combination of all of its structures for the functions specified.

There has thus been outlined, rather boardly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved window rain shield apparatus which has all the advantages of the prior art window rain shield apparatus and none of the disadvantages.

It is another object of the present invention to provide a new and improved window rain shield apparatus which may be easily any efficiently manufactured and marketed.

It is further object of the present invention to provide a new and improved window rain shield apparatus which is of a durable and reliable construction.

An even further object of the present invention is to provide a new and improved window rain shield apparatus which is susceptible of a low cost of manufacture with regard to both materials and labor, and which accordingly is then susceptible of low prices of sale to the consuming public, thereby making such window rain shield apparatus economically available to the buying public.

Still yet another object of the present invention is to provide a new and improved window rain shield apparatus which provides in the apparatuses and methods of the prior art some of the advantages thereof, while simultaneously overcoming some of the disadvantages normally associated therewith.

Still another object of the present invention is to provide a new and improved window rain shield apparatus wherein the same is configured for mounting between a lower window sash and a window sill to effect an opening overlying the apparatus forwardly of the window sash to prevent undesired debris and moisture from entering a dwelling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention.

FIG. 4 is an isometric, enlarged illustration of the instant invention.

DESCRIPTION OF THE PREFERRED EMBODIMENT

Figure 1:
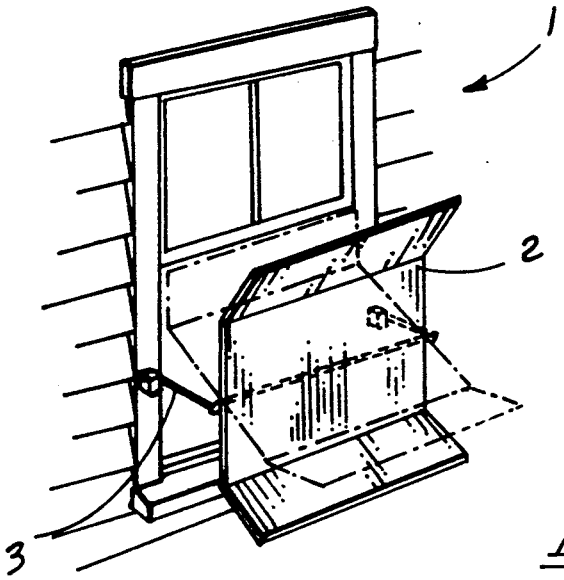
Fig 1 PRIOR ART
FIG. 1 is an isometric illustration of a prior art window shield apparatus.

With reference now to the drawings, and in particular to FIGS. 1 to 8 thereof, a new and improved window rain shield apparatus embodying the principles and concepts of the present invention and generally designated by the reference numeral 10 will be described.

Figure 2:
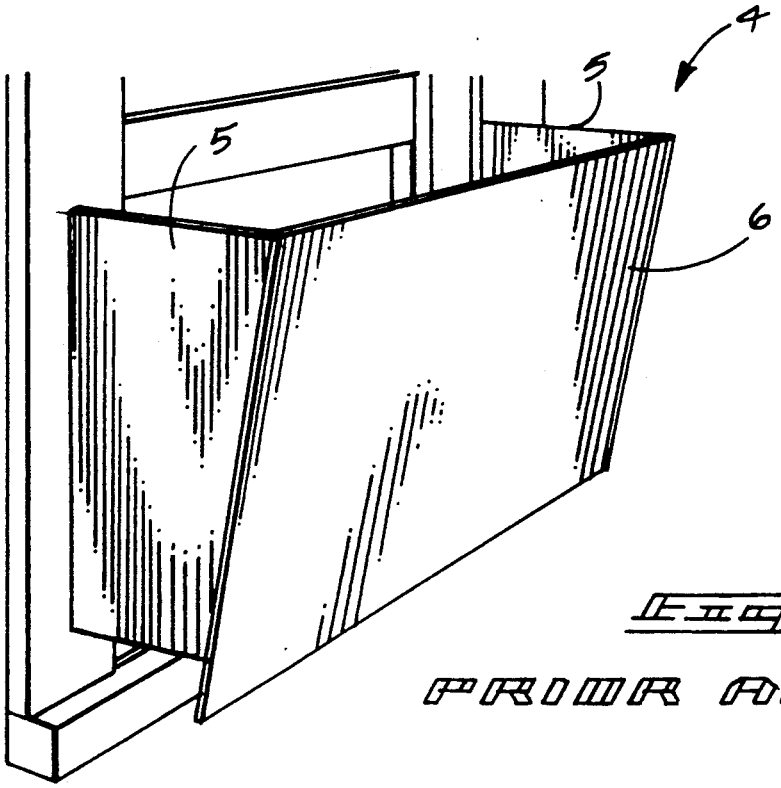
Fig 2 PRIOR ART
FIG. 2 is an isometric illustration of a further example of a window shield apparatus as set forth in the prior art.

FIG. 1 illustrates a prior art window shield apparatus 1, wherein a generally "U" shaped shield 2 includes a rod-like framework 3 to permit pivotment of the shield 2 relative to a rearwardly positioned window, in a manner as set forth in U.S. Pat. No. 3,116,519. FIG. 2 illustrates a further window shield apparatus 4, wherein spaced side walls 5 mount a forward plate 6 in a spaced relationship relative to a window providing an opened bottom and top entrance for directing or air therethrough, as set forth in U.S. Pat. No. 2,663,245.

Figure 5:
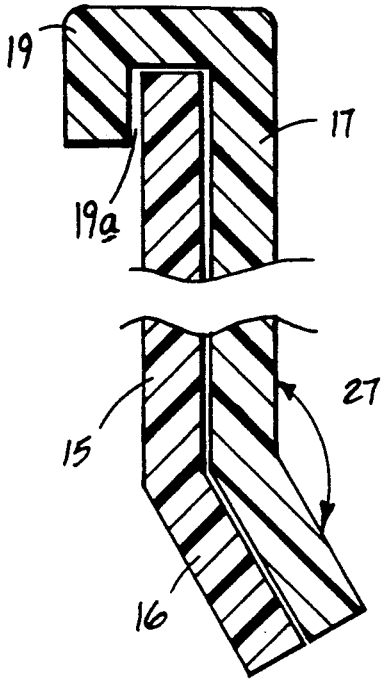
FIG. 5 is an orthographic view, taken along the lines 5—5 of FIG. 4, in the direction indicated by the arrows.

More specifically, the rain shield apparatus 10 of the instant invention essentially comprises the organization in combination with a window defined by a window that includes an upper window member and a lower window member slidable relative to one another, with the lower window member including a lower window sash 11 in sliding cooperation with a window sill 12. The shield apparatus includes a first triangular side plate 13 spaced from and parallel a second triangular side plate 14, with each side plate formed as a right triangle defined by a respective top edge 13*a* and 14*a* that are arranged coextensively and parallel relative to one another in a single plane, with a rear free edge defining a hypotenuse as exemplified by the respective first and second rear edge 13*b* and 14*b* arranged for mounting between the lower window sash 11 and window sill 12. A first shield plate 15 is orthogonally mounted to the second triangular side plate 14 coextensively with the vertical edge thereof and includes a first shield plate sealing flange 16 defining an obtuse angle, such as obtuse angle 27, as illustrated in FIG. 5, between exterior surfaces of the first shield plate 11 and the first shield plate sealing flange 16. The shield plate 15 and sealing flange 16 are telescopingly received within a first shield housing 17 that includes a first lip housing 18 that are coextensively formed relative to the shield plate 15 and the sealing flange 16. The shield housing 17 includes an "L" shaped flange 19 (see FIG. 5) defining a channel 19*a* to receive the first shield plate therewithin. In this manner, the organization may be adjusted for accommodating a varied width underlying an associated lower window sash 11.

Figure 6:
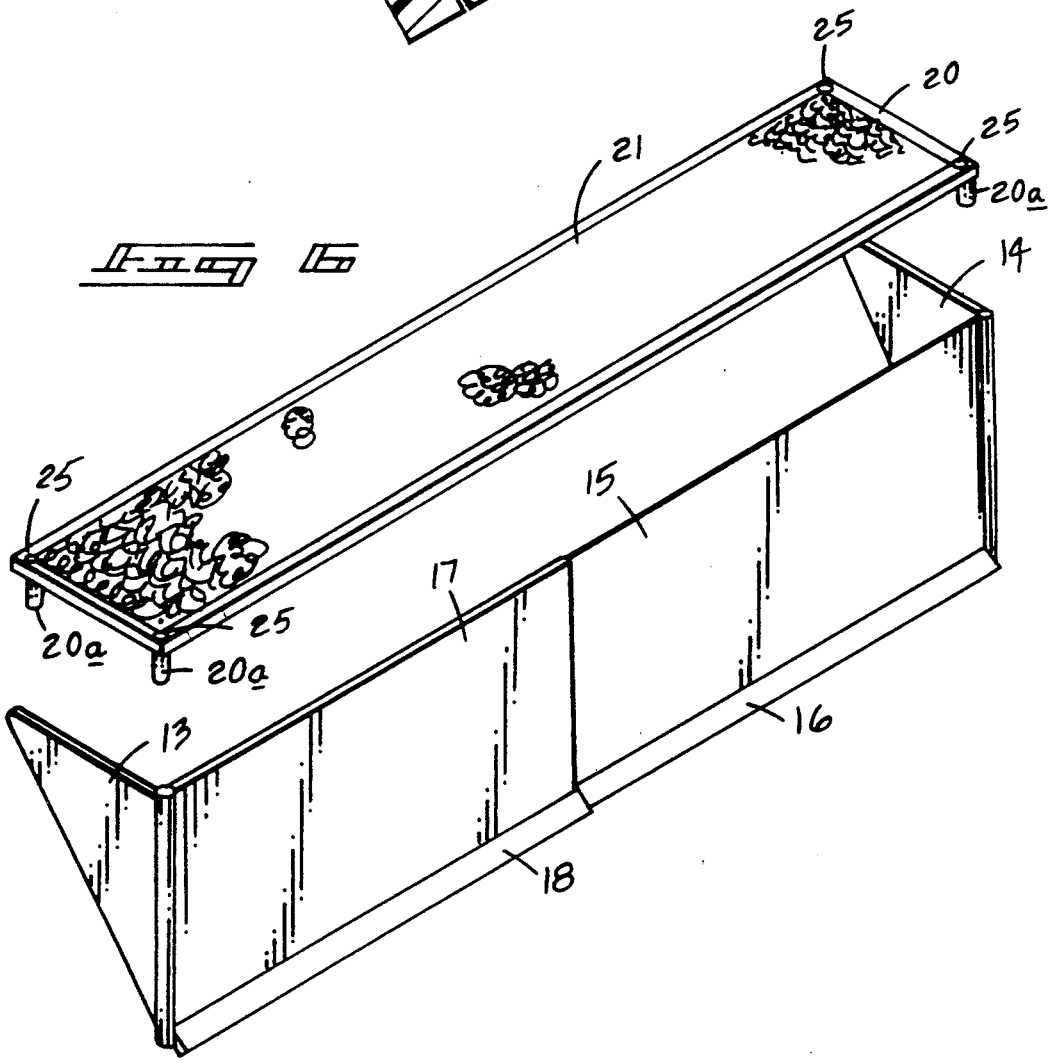
FIG. 6 is an isometric illustration of the instant invention setting forth the use of a filtration screen therewith.
Figure 7:
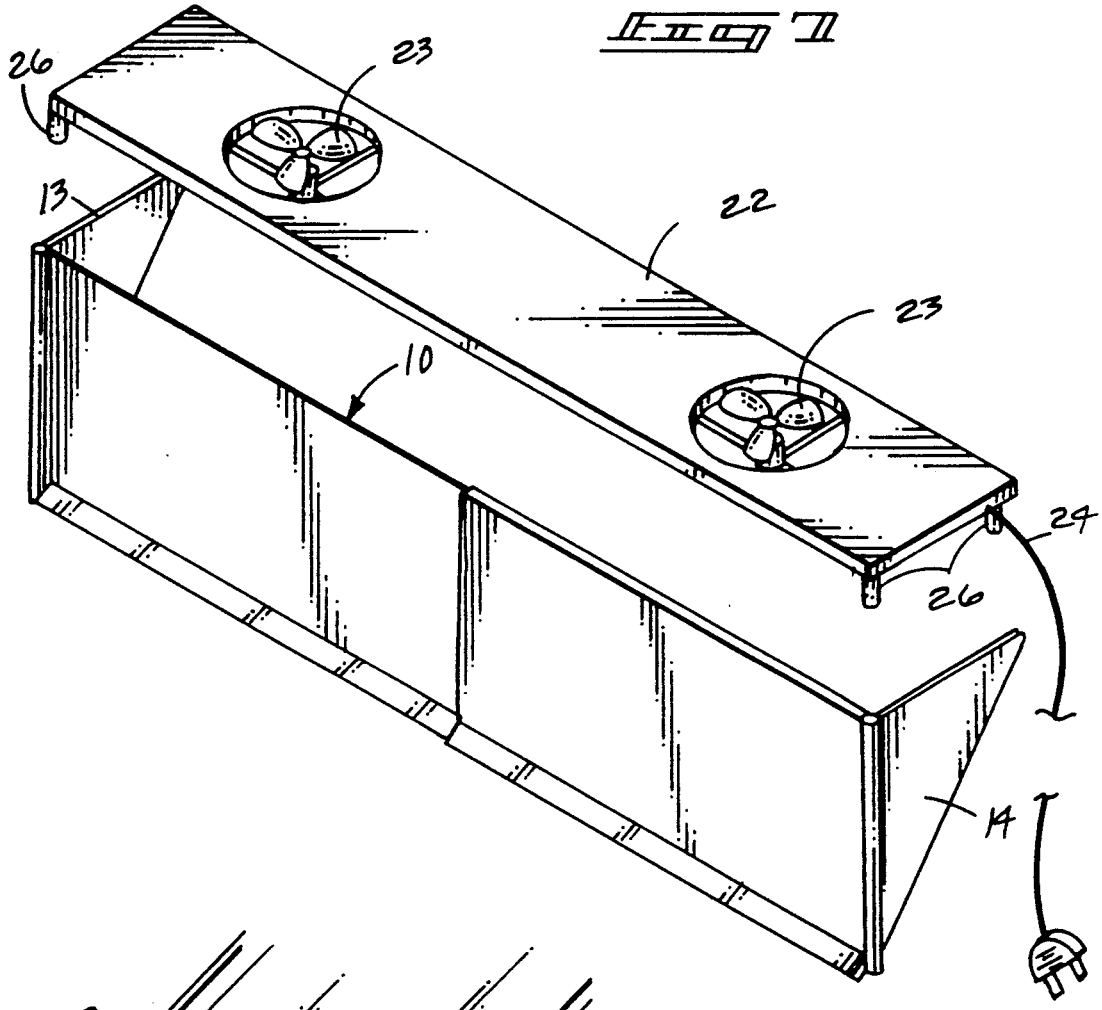
FIG. 7 is an isometric illustration of the instant invention utilizing a forced air ventilation plate.
Figure 8:
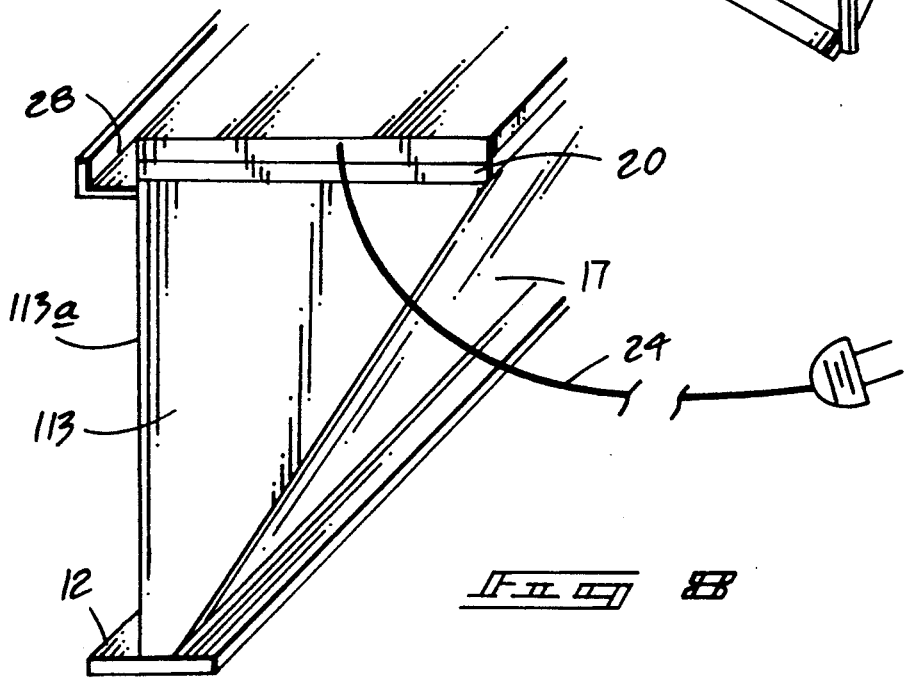
FIG. 8 is an isometric illustration of the instant invention illustrating the use of the shield, ventilation plate, and an "L" shaped abutment flange for use by the instant invention.

Reference to FIG. 6 illustrates the use of a rectangular frame 20 that includes registraton legs 20*a* mounted at lower terminal ends thereof orthogonally and fixedly secured to corner portions of the rectangular frame 20, wherein the registration legs 20*a* underlie positioning bores 25. The use of positioning bores 25 will be discussed below. A filter screen 21 is coextensively mounted within the rectangular frame 20 and includes a charcoal impregnated screen, as well as a liquid scent impregnating fluid therewithin to permit enhancement of the odoriferous quality of air directed through the filter screen 21. Further, the organization permits use of a fan plate 22, including a plurality of spaced motorized fan members 23 that are arranged to overlie the filter screen or independently thereof. The fan plate 22 includes positioning legs 26 arranged at each corner thereof received within the positioning bores 25 that are formed adjacent each corner of the rectangular frame 20 to effectively lock the fan plate 22 to the rectangular frame 20. Further, each side plate 13 may further formed with an "L" shaped abutment flange 28 that is orthogonally mounted to the rear terminal edge 113*a* to provide an abutment stop for the window sill 12 received therewithin. As noted, the triangular side plates may be further configured with the rear terminal edges, such as rear terminal edge 113*a* formed as the vertical leg of the right triangular configuration, with the hypotenuse formed as the forward edge joined to the shield housing 17 and associated plate 15.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A window rain shield apparatus in combination with a window, wherein the window includes an upper window and a lower window, with the lower window relatively movable relative to the upper window, and the lower window including a lower window sash cooperative with a window sill, and the apparatus includes a first triangular side plate and a second triangular side plate, with each first and second triangular side plate positionable between the lower window sash and the window sill, and the first triangular side plate including a planar shield housing, the shield housing telescopingly receiving a shield plate, the shield plate orthogonally mounted to the second triangular side plate, and wherein the shield housing includes a lip housing coextensively mounted to a lower terminal edge of the shield housing defining a fixed obtuse angle therebetween, and the shield plate including a shield plate flange mounted to a lower terminal edge of the shield plate defining the fixed obtuse angle therebetween, and wherein the shield housing includes an "L" shaped flange mounted coextensively to an upper terminal edge of the shield housing defining a channel to receive the shield plate therewithin, and further including a rectangular frame, the rectangular frame including a registration leg orthogonally and fixedly mounted to a lower terminal edge of the rectangular frame adjacent each corner of the rectangular frame, and the rectangular frame including a filter screen mounted coextensively within the rectangular frame, the filter screen including a charcoal and liquid scent impregnated webbing to enhance filtration of air directed therethrough, and wherein the rectangular frame includes a positioning bore directed orthogonally to the rectangular frame adjacent each corner thereof overlying each positioning leg, and a rectangular fan plate, the rectangular fan plate including a fan plate leg orthogonally and fixedly mounted to the fan plate adjacent each corner thereof, with each fan plate leg receivable within an associated positioning bore, and the fan plate including a plurality of motorized fan members, each fan member mounted within an opening within the fan plate for directing air through the fan plate and the filter screen.

* * * * *